US006669249B1

(12) United States Patent
Huang et al.

(10) Patent No.: US 6,669,249 B1
(45) Date of Patent: Dec. 30, 2003

(54) LEVER HANDLE SUPPORT MECHANISM

(75) Inventors: Richard Hai Huang, West Haven, CT (US); Paul Nunez, Orange, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 10/243,925

(22) Filed: Sep. 13, 2002

(51) Int. Cl.[7] ..... E05B 9/00

(52) U.S. Cl. ..... 292/337; 292/347; 292/349; 292/DIG. 53

(58) Field of Search ..... 292/337, 336.3, 292/349, 356, DIG. 53, DIG. 8, DIG. 30, 346, 357; 403/83, 84, 88

(56) References Cited

U.S. PATENT DOCUMENTS

| | | | | | |
|---|---|---|---|---|---|
| 1,808,048 | A | * | 6/1931 | Lowe | 292/356 |
| 3,314,708 | A | * | 4/1967 | Welch | 292/336.5 |
| 3,853,341 | A | * | 12/1974 | MacDonald | 292/171 |
| 3,885,269 | A | * | 5/1975 | Helland | 292/336.3 |
| 3,974,671 | A | * | 8/1976 | Rossetti | 70/375 |
| 4,126,340 | A | * | 11/1978 | Pelcin | 292/1 |
| 4,502,720 | A | * | 3/1985 | Fayerman et al. | 292/348 |
| 4,784,418 | A | * | 11/1988 | Pearson et al. | 292/348 |
| 5,992,189 | A | * | 11/1999 | McCaa | 70/149 |
| 6,295,702 | B1 | * | 10/2001 | Bauer | 24/303 |
| 6,494,506 | B1 | * | 12/2002 | Gleason et al. | 292/216 |
| 2002/0113445 | A1 | * | 8/2002 | Brown | 292/336.3 |
| 2003/0030286 | A1 | * | 2/2003 | Mintgen et al. | 292/195 |

FOREIGN PATENT DOCUMENTS

| | | | | |
|---|---|---|---|---|
| EP | 568896 A2 | * | 11/1993 | E05B/3/06 |
| GB | 2064639 A | * | 6/1981 | E05C/13/02 |

* cited by examiner

*Primary Examiner*—J. J. Swann
*Assistant Examiner*—Thomas Ho
(74) *Attorney, Agent, or Firm*—DeLio & Peterson, LLC

(57) ABSTRACT

A handle support mechanism is designed for attachment to a door lock, preferably the exterior of a mortise lock, that has two handles driven back to an initial position with a common return spring after either handle is used. The support mechanism prevents the unused handle from drooping or rotating when the common return spring is compressed as the opposite handle is turned. The support mechanism includes first and second friction discs trapped between the exterior of the mortise lock and the legs of a U-shaped spring bracket. The spring bracket applies an inward spring pressure to prevent a friction disc and its corresponding handle from turning when the other handle is in use. The handle support mechanism improves visual appearance and is particularly suitable for retrofit installations, lever handle designs and mortise locks with independent switch sensors on the two handles that notify a monitoring system as to which handle was turned to open a monitored door.

38 Claims, 4 Drawing Sheets

LEVER HANDLE SUPPORT MECHANISM

BACKGROUND OF THE INVENTION

1. Field of the Invention

The present invention relates to mortise locks equipped with lever handles. More particularly, the present invention relates to mortise locks where inner and outer lever handles are held level by a common spring return mechanism and where it is necessary to support one handle in the level position while the opposite handle is being operated against the pressure of the common spring return.

2. Description of Related Art

A mortise lock is operated by inner and outer handles located on opposite sides of the mortise lock case and typically includes a spring return mechanism that returns a handle to its initial position after it is rotated. Provided the mortise lock is in the unlocked state, rotation of either handle will retract the latch bolt, compress the spring return and open the door. When the rotated handle is released, the spring return mechanism returns the handle to its original position.

In a conventional mortise lock design, the inner and outer handles are mounted on separate shafts and operate independently, thereby allowing one handle to be locked while still permitting the opposite handle to turn and open the door. Because both handles ultimately connect to the latchbolt, however, a single spring return mechanism is often used to return both handles to their starting level position.

When the handles are conventional round doorknobs, rotation of one knob and compression of the common spring return mechanism due to that rotation will normally have no effect on the opposite knob. However, when lever handles are used, compression of the common spring return mechanism, by rotation of one lever handle, causes the opposite lever handle to droop. This droop occurs because, unlike a cylindrically symmetrical doorknob, the center of gravity of a lever handle is offset from its axis of rotation. This offset constantly applies a gravitational torque to the lever handle due to the weight of the lever portion of the handle, which must be opposed by the spring return mechanism. When the counteracting spring pressure is removed the unused lever handle droops downward, following the motion of the lever handle in use.

The appearance of a drooping handle is visually undesirable. Moreover, in some applications this drooping motion of the unused handle interferes with the desired function of the lock. One such application is in a monitored mortise lock design in which separate switches are operated by the handles. The switches are triggered whenever the handle they monitor rotates. This is intended to allow the monitoring system to determine which handle was used.

When a switch-monitored mortise lock of this type has conventional round doorknobs installed, the switches operate independently and the monitoring system is able to determine which of the two handles was operated to open the mortise lock. Thus, the monitoring system can tell whether the door was opened from the inside or from the outside.

However, when lever handles are installed in a switch-monitored mortise lock of this type, the drooping motion of the unused lever handle causes both switches to operate when either handle is used. This prevents the monitoring system from detecting which handle was used to open the door. The problem also occasionally occurs with round doorknobs in mortise lock designs that frictionally transmit some of the rotational force from the operated handle to the non-operated handle.

Although a redesign of the mortise lock mechanism to incorporate additional springs in the mortise case may solve this problem, such redesign is expensive and is not warranted for the limited number of applications where handle droop during operation of the opposite handle is a problem.

Bearing in mind the problems and deficiencies of the prior art, it is therefore an object of the present invention to provide a handle support mechanism that will prevent the non-operated handle from turning when the opposite handle is being rotated.

It is another object of the present invention to provide a handle support mechanism that can be installed on existing designs in the field without modification to the mortise lock.

A further object of the invention is to provide a handle support mechanism that is relatively inexpensive to manufacture.

SUMMARY OF THE INVENTION

The above and other objects, which will be apparent to those skilled in art, are achieved in the present invention which is directed to a handle support mechanism for attachment to a lock having first and second handles. The mechanism includes first and second friction elements with corresponding friction surfaces. The friction elements are connected to and rotationally driven by their respective handles when the handles are turned. First and second non-rotatable friction surfaces are non-rotatably mounted relative to the lock such that they are in frictional contact with the corresponding friction surfaces on the friction elements. A bracket may be free-floating or mounted to the lock and acts to hold the friction surfaces on the first and second friction elements in frictional contact with the first and second non-rotatable friction surfaces. Engagement between the friction surfaces on the friction elements (which turn with the handles) and the non-rotatable friction surfaces (which cannot turn with the handles) prevents an unsupported handle from rotating or drooping.

The bracket is preferably a spring bracket that applies an inward spring force to engage the rotating and non-rotating friction surfaces. The friction elements may be formed as discs with cylindrical bearing surfaces that engage bearing holes in the bracket. The handle support mechanism is particularly suitable for installation to the exterior of a mortise lock. The preferred embodiment may be installed with no fasteners without modifying the mortise lock in any way. In this design the bracket is a generally U-shaped spring bracket that includes a base portion and a pair of legs separated by a distance corresponding to the thickness of the mortise lock. The legs of the bracket extend to opposite sides of the mortise lock and the bracket floats, automatically moving towards a handle that is turned to reduce friction on that side and increase friction on the opposite, non-turning side.

Although the friction surfaces may provide a uniform friction as the handles turn, in the preferred embodiment of the invention, the rotating and non-rotating friction surfaces use dimples and notches to releasably engage each other. This provides a "detent" action that initially resists handle rotation with a relatively high friction, but then drops to a relatively low friction level as the handle turns from its initial position. In the embodiment illustrated, four dimples are produced on each inner, friction surface, leg of the spring bracket and four corresponding notches are produced around the perimeter of each friction disc.

The bracket is preferably made of spring steel and the friction discs are preferably formed of sintered powdered metal. The sintered metal part is infiltration treated to increase density and reduce porosity, then plated, and finally an anti-wear coating applied. The anti-wear coating may include polytetrafluoroethylene (PTFE), which paradoxically reduces friction on the friction surfaces of the friction discs. This has the desirable effect (due to the dimple/notch detent interaction) that the desired handle support action is produced in the vicinity of the initial handle position and low handle turning friction is produced elsewhere.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–11 of the drawings in which like numerals refer to like features of the invention.

Figure 1:
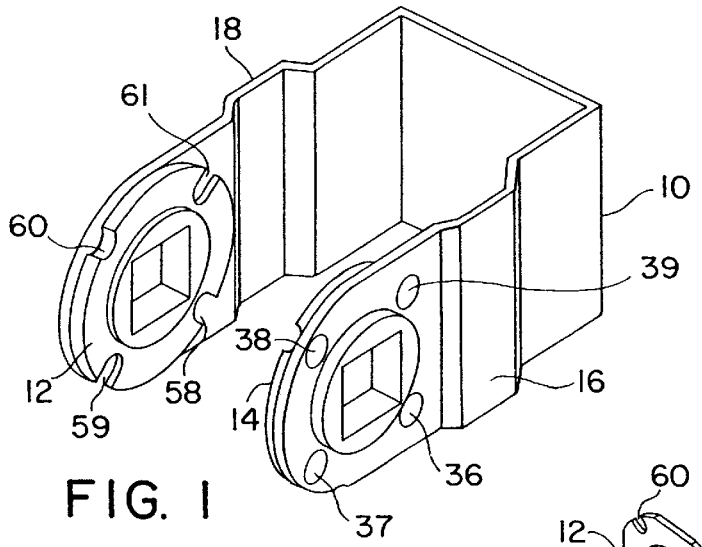
FIG. 1 is a perspective view of a first embodiment of a lever handle support mechanism according to the present invention.
Figure 2:
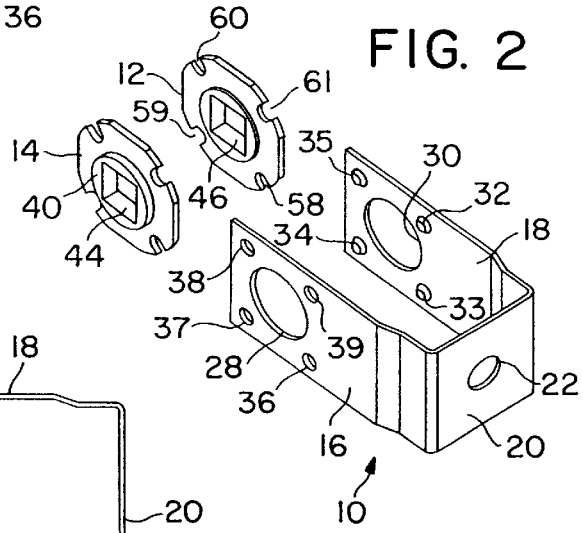
FIG. 2 is an exploded perspective view of a second embodiment of a lever handle support mechanism according to the present invention.
Figure 3:
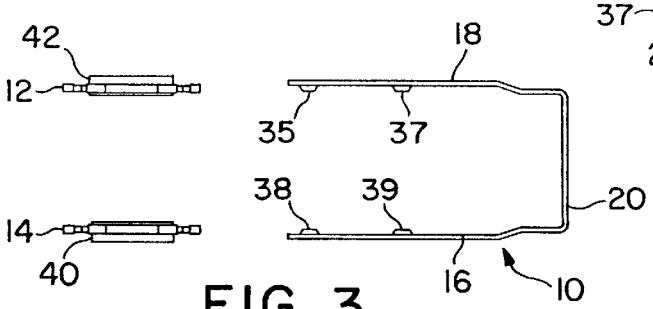
FIG. 3 is a plan view of the exploded second embodiment of the lever handle support mechanism seen in FIG. 2.
Figure 4:
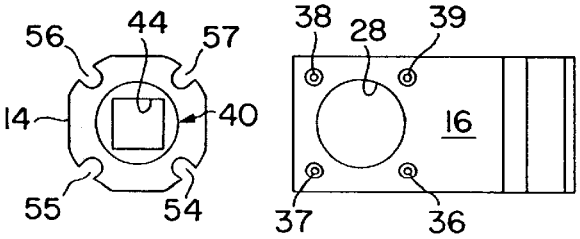
FIG. 4 is a side elevational view of the exploded second embodiment of the lever handle support mechanism seen in FIG. 2.
Figure 5:
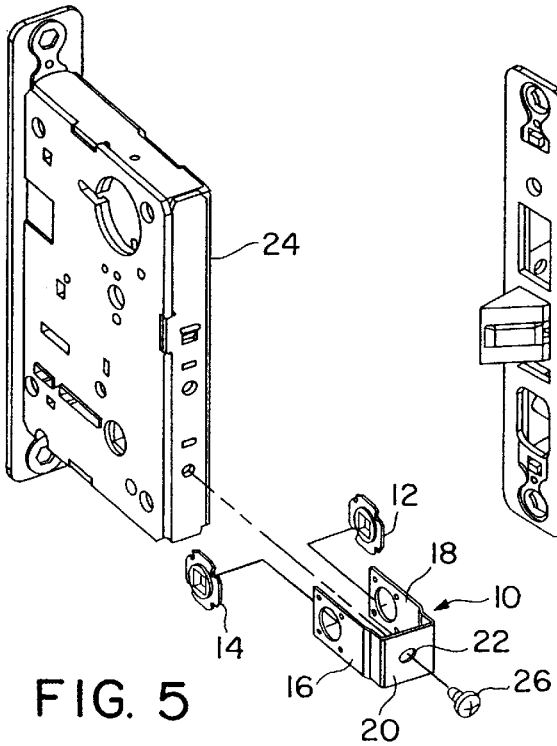
FIG. 5 is an exploded perspective view of the second embodiment of the lever handle support mechanism illustrating how it is attached to a mortise lock. Lever handles are not shown.
Figure 8:
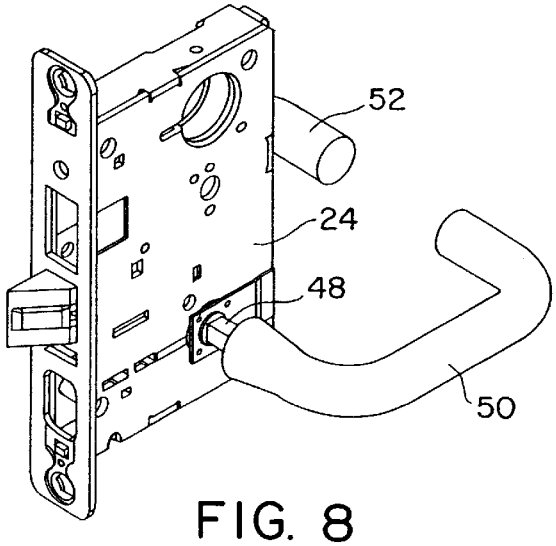
FIG. 8 is a perspective view showing the second embodiment of the lever handle support mechanism and the mortise lock of FIG. 5 with lever handles installed.
Figure 6:
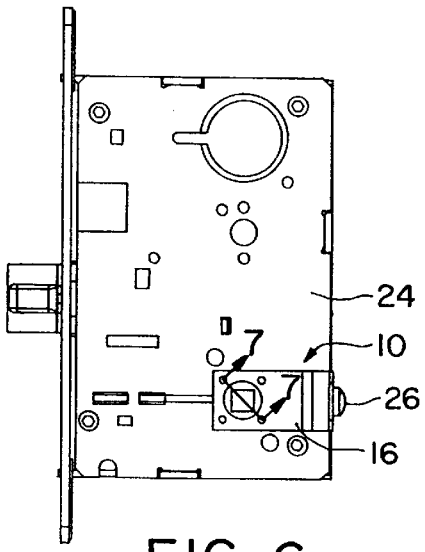
FIG. 6 shows the second embodiment of the lever handle support mechanism installed on the mortise lock seen in FIG. 5.
Figure 7:
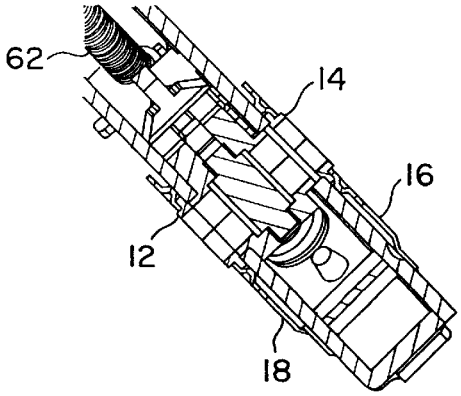
FIG. 7 is a partial cross sectional view of the second embodiment of the lever handle support mechanism and mortise lock taken along the line 7—7 in FIG. 6.

FIG. 1 shows a first embodiment of the present invention and FIGS. 2–4 show a second embodiment of the invention. FIGS. 5–11 use the embodiment of FIGS. 2–4 to illustrate how the invention is attached to a conventional mortise lock. The two embodiments function in substantially the same way and are attached to a mortise lock in the same manner. Consequently, the same reference numbers are used in connection with both embodiments of the invention. The embodiments in FIGS. 1 and 2 differ only in the shape of the corners, the bends in the spring bracket 10 and the elimination of mounting hole 22. With mounting hole 22 eliminated, the spring bracket 10 is self-supporting and floats on handle spindles 48, 49 (see FIG. 8), as described below.

The invention includes a U-shaped spring bracket 10 and a pair of friction discs 12, 14 held in two legs 16, 18 of the spring bracket. The two legs 16, 18 are connected by a spring bracket base 20, which has a mounting hole 22 in it.

As can be seen in FIGS. 5–8, with the invention installed on the mortise lock 24, the distance between bracket legs 16, 18 is approximately the same as the width of the mortise lock. With the spring bracket not installed, the legs of the bracket angle inward to produce a spring preload. The spring bracket can be mounted with mounting screw 26 (see FIGS. 5 and 6), which extends through mounting hole 22. Alternatively, the spring bracket can be allowed to float freely, which makes it self-aligning.

Spring bracket legs 16, 18 are each provided with a corresponding bearing hole 28, 30. One or more dimples 32–39 surround each bearing hole. The friction discs 12, 14 each include a cylindrical bearing surface 40, 42. The cylindrical bearing surface on each friction disc has a diameter that is just slightly less then its corresponding bearing hole 28, 30. Each friction disc is inserted from the inside of the U-shaped spring bracket 10 into its corresponding bearing hole.

As can be seen in FIGS. 5–8, the friction discs are trapped between the spring bracket legs 16, 18 and the outer surfaces of the mortise lock 24. Referring again to FIGS. 1–4 it can be seen that the friction discs 12, 14 are provided with square holes 44, 46 at their centers. The square hole 44 in friction disc 14 engages handle shaft 48 extending from lever handle 50 (see FIG. 8). The square hole 46 in friction disc 12 engages handle shaft 49 extending from lever handle 52 (see FIGS. 9 and 10, which are drawn from the reverse angle).

Whenever a lever handle 50, 52 rotates, its corresponding friction disc 14, 12 also rotates. As can be seen best in FIG. 4, each of the dimples 36–39 on spring bracket leg 16 mates with a corresponding notch or depression 54–57 formed in the perimeter of friction disc 14. Four similar notches 58–61 are found in the perimeter of friction disc 12, which mate with corresponding dimples 32–35 in spring bracket leg 18 (see FIG. 2). The dimples in the spring legs engage their corresponding notches in the friction discs and function to hold the friction discs in a preferred level position. More or less than four corresponding notches and dimples may be used.

When the spring bracket is allowed to float (screw 26 not installed), the handle spindles 48, 49 hold the friction discs in coaxial alignment and support the spring bracket on the cylindrical bearing surfaces 40, 42 as they engage the bearing holes 28, 30. In this implementation, the spring bracket is self-aligning and the preload of the spring bracket is particularly important. This self-aligning spring bracket installation method reduces cost by reducing the number of parts (screw 26 is eliminated) and by eliminating the manufacturing step needed to make hole 22. It also significantly improves performance by allowing the spring bracket to move from side to side in a particularly advantageous manner.

Specifically, as a handle is turned, the dimples on the spring bracket leg on that side will lift out of their corresponding notches. This moves the spring bracket towards the handle being turned. This motion of the bracket towards the turning handle decreases the spring pressure on the rotating side, thereby desirably decreasing both wear and friction on that side. Simultaneously, the motion of the spring bracket away from the non-rotating handle increases the inwardly applied spring pressure on the non-rotating side. This increased spring pressure increases the friction between the spring bracket and the friction disc on the non-rotating side, thereby improving the support for the non-rotating handle.

Figure 9:
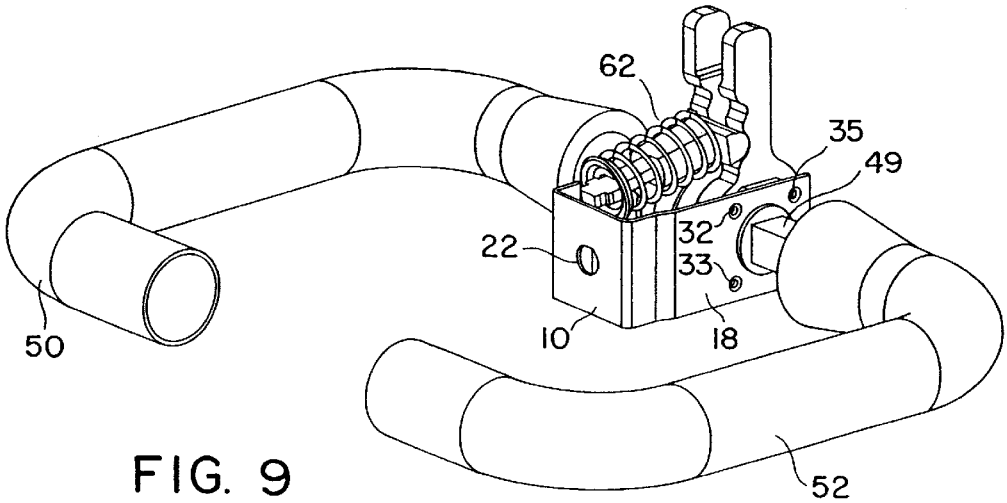
FIG. 9 is a perspective view showing the second embodiment of the lever handle support mechanism, lever handles and a spring mechanism found in the mortise lock of FIG. 5 that supports the lever handles. The lever handles are shown in the level position. The mortise lock case and other mortise lock components are not shown.
Figure 10:
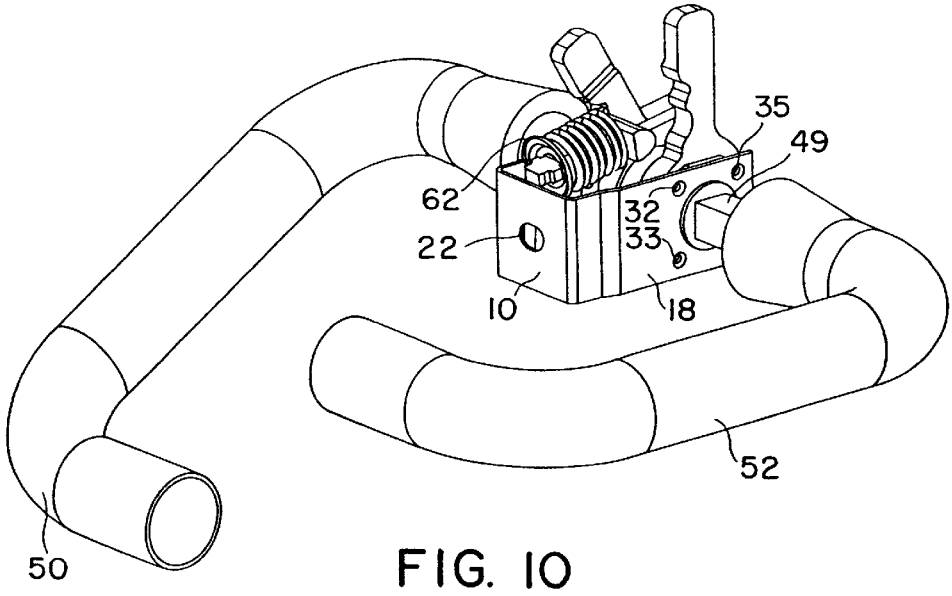
FIG. 10 is a perspective view corresponding to FIG. 9 except that one lever handle is shown in the level position being supported by the lever handle support mechanism of the present invention and the other handle is shown deflected to the position needed to operate the mortise lock and retract the latch.
Figure 11:
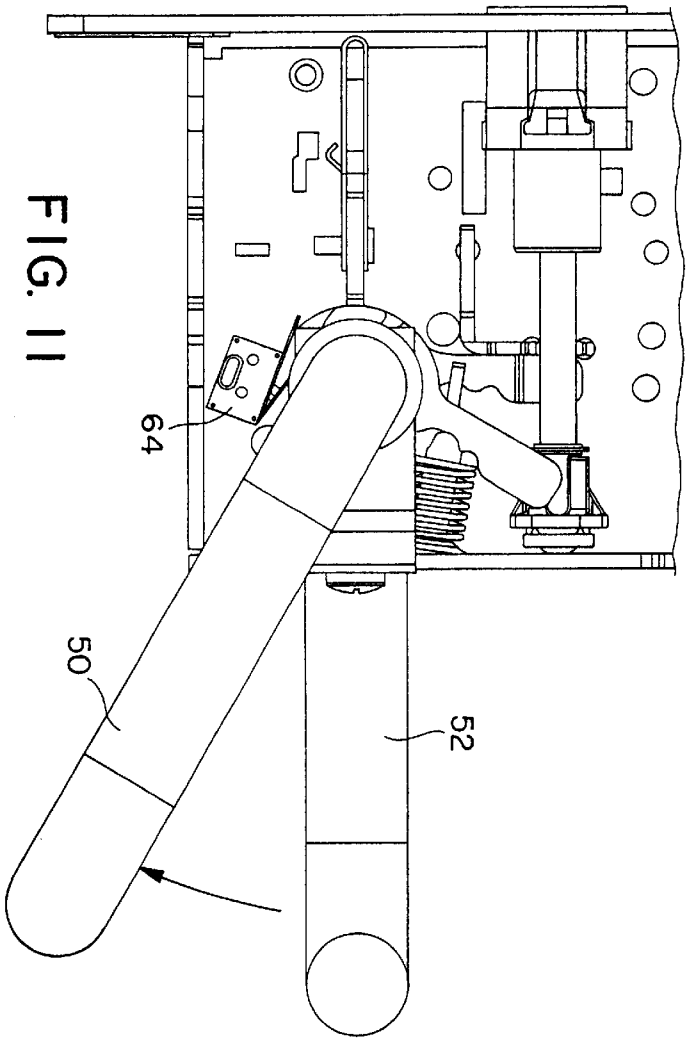
FIG. 11 is a side elevational view corresponding to FIG. 10 except that additional components of the mortise lock are shown, including one of two switches that sense the position of the lever handles. The two switches allow a monitoring system connected to the switches to determine whether the inner lever handle or the outer lever handle was operated. Only one of the two switches can be seen in this side elevational view because the second switch is hidden behind the first switch.

When handle 50 is operated (compare FIGS. 9 and 10) it compresses the common support spring 62 and removes the spring support from handle 52 as can be seen in FIG. 10. Note that FIGS. 9 and 10 show the handles reversed from FIG. 8 to better illustrate the mechanism providing common support between the handles. FIG. 11 shows how sensor switch 64 is installed to monitor handle 50. A second sensor switch (hidden by the visible switch 64 in FIG. 11) monitors the opposing handle 52.

Without the handle support of this invention, when handle 50 is operated, the opposite handle 52 will droop. The drooping motion of the non-operated handle will operate its sensor switch. When both sensor switches operate, the monitoring system cannot determine which handle was turned to gain entrance or exit.

The present invention solves this problem (and improves the appearance of the lock by preventing handle droop) without necessitating modification of the internal design of the mortise lock. The non-operated handle 52 is supported against the force of gravity when the opposite lever handle 50 is used. As can be seen in FIGS. 5–10, the spring bracket and associated friction discs are easily installed on the outside of an assembled mortise lock 24.

Although the preferred embodiment of the invention uses dimples on the spring bracket and corresponding notches on the friction disc, the invention may be implemented in many alternative ways. Specifically, the dimples and notches may be eliminated completely and friction surfaces may be used alone to prevent handle droop by the non-operated handle. Alternatively, instead of notches, depressions may be used or the number of notches, dimples, etc. may be varied. Further, the dimples and notches may be reversed so that the dimples are on the friction disk and corresponding depressions or notches are on the spring bracket legs.

In the preferred design, with dimples and notches, as handle 50 is. turned, it spins its corresponding friction disc 14, and spring bracket leg 16 is forced outward as the four dimples 36–39 are pushed out of their corresponding notches 54–57 in friction disc 14. As the common support spring 62 is compressed, the opposing handle 52 loses its support. However, the inward spring pressure of spring bracket leg 18 holds dimples 32–35 engaged with notches 58–61 in friction disc 12 and the opposing lever handle 52 is prevented from drooping or actuating its corresponding switch.

The spring bracket 10 is shaped such that when it is installed, the spring preload causes the two spring bracket legs 16, 18 to provide oppositely directed inward spring forces to squeeze the friction discs 12, 14 between the inner surfaces of the spring bracket and outer surfaces on the mortise lock 24. In the preferred design, the inner surfaces of the spring bracket legs 16, 18 are friction surfaces with notches, dimples or other friction-producing surface irregularities that cooperate with corresponding friction surfaces on the outer surfaces of the friction discs.

Alternatively, or in addition to these friction surfaces, friction surfaces may be produced on the outer surfaces of the mortise lock and on the inner surfaces of the friction discs. The friction surfaces on the friction discs must frictionally contact corresponding friction surfaces that do not rotate relative to the lock, but these surfaces may be formed on the spring bracket, as shown, or on the lock, or they may be separate elements attached to the lock or the bracket.

The spring bracket 10 is preferably formed by stamping from spring steel. The spring steel is preferably heat-treated after stamping. The frictions discs should be hard and wear resistant. They may be made by machining, but may also be formed from powdered metal, such as sintered copper steel. To improve wear resistance when made from powdered metal, the friction discs are infiltration processed to increase density, heat-treated and electrolessly coated with nickel and nickel/ polytetrafluoroethylene. Polytetrafluoroethylene (PTFE) is a friction reducing and wear-reducing material sold under the trade name Teflon.

The terms "dimple" and "notch" are used herein to broadly refer to mating dimples, notches, bumps, depressions, slots, corrugations, ramps and other surface shapes and irregularities that may be used to releasably engage each other as needed to hold a lever handle in a level position or in a desired angular orientation against a moderate rotational force, but which release the engagement when a sufficient force is applied. The terms are also intended to refer to other known structures of this type, such as roller balls, bearings, springs and clips that may be used alone or in combination with surface irregularities for releasably supporting a lever handle.

The term "friction surface" is used herein to refer to surfaces that may have dimples and/or notches of the type described above, as well as to surfaces that do not have such surface irregularities. The term is broadly used to refer to surfaces that have sufficient friction or engagement relative to another surface to support a lever handle and prevent it from drooping. The use of the term "friction surface" to refer to surfaces provided with dimples and notches or other surface irregularities is not necessarily intended to imply that there is any significant friction once the dimples and notches have disengaged. Moreover, in the preferred design, the "friction discs" are coated with a wear-reducing, relatively low friction, PTFE or Teflon-containing layer.

Thus, the frictional contact between engaging friction surfaces, such as between the inner friction surfaces on the inside of the spring bracket (containing the dimples) and the corresponding friction surfaces on the outside of the friction discs (containing the notches) may produce relatively little friction between the friction surfaces after the dimples have disengaged from the notches. The invention is intended to cover both high friction and low friction designs that provide the desired lever handle support for the unused handle while the opposite handle is in use, regardless of the friction produced while a handle is being rotated.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A handle support mechanism for attachment to a lock operable by first and second handles, the handle support mechanism comprising:

a first friction element comprising a disc having a friction surface and a first cylindrical bearing surface, the first friction element being connected to and rotationally driven by the first handle when the first handle is turned;

a second friction element comprising a disc having a friction surface and a second cylindrical bearing surface, the second friction element being connected to and rotationally driven by the second handle when the second handle is turned;

a first non-rotatable friction surface in frictional contact with the friction surface on the first friction element;

a second non-rotatable friction surface in frictional contact with the friction surface on the second friction element, the first and second fixed friction surfaces being non-rotatable relative to the lock; and a bracket holding the friction surfaces on the first and second friction elements in frictional contact with the first and second non-rotatable friction surfaces, the bracket including first and second bearing holes engaging the first and second cylindrical bearing surfaces to rotationally hold the first and second friction elements.

2. The handle support mechanism of claim 1 wherein:

the bracket includes the first non-rotatable friction surface and the friction surface on the first friction element is an outer surface of the first friction element; and the bracket also includes the second non-rotatable friction surface and the friction surface on the second friction element is an outer surface of the second friction element.

3. The handle support mechanism of claim 1 wherein the bracket is a spring bracket providing a first inward spring force between the friction surface on the first friction element and the first non-rotatable friction surface and a second, oppositely directed, inward spring force between the friction surface on the second friction element and the second non-rotatable friction surface.

4. The handle support mechanism of claim 3 wherein:

the lock is a mortise lock having a thickness; and the bracket is generally U-shaped and includes a base portion and a pair of legs separated by a distance corresponding to the thickness of the mortise lock, the legs extending to opposite sides of the mortise lock.

5. The handle support mechanism of claim 4 wherein the bracket comprises a self-aligning spring bracket not rigidly attached to the mortise lock.

6. The handle support mechanism of claim 4 wherein the base portion of the bracket is attached to a back surface of the mortise lock.

7. The handle support mechanism of claim 3 wherein the bracket is made of spring steel.

8. The handle support mechanism of claim 1 wherein the bracket and the first and second friction elements are externally mounted to the lock.

9. The handle support mechanism of claim 1 wherein the handle support mechanism is externally mounted to the lock without any fasteners.

10. The handle support mechanism of claim 1 wherein the first and second non-rotatable friction surfaces include at least one dimple in frictional contact with corresponding notches formed in the friction surfaces of the first and second friction elements.

11. The handle support mechanism of claim 10 wherein the first and second non-rotatable friction surfaces each include four dimples and the friction surfaces of the first and second friction elements each include four corresponding notches.

12. The handle support mechanism of claim 1 wherein:

the first friction element disc includes the first cylindrical bearing surface and a square hole extending axially therethrough for engaging a first spindle extending from the first handle; and the second friction element disc includes the second cylindrical bearing surface and a square hole extending axially therethrough for engaging a second spindle extending from the second handle.

13. The handle support mechanism of claim 12 wherein the friction discs are formed of sintered powdered metal.

14. The handle support mechanism of claim 13 wherein the friction discs are coated with an anti-wear coating.

15. The handle support mechanism of claim 13 wherein the friction discs are plated with nickel before the anti-wear coating is applied.

16. The handle support mechanism of claim 14 wherein the anti-wear coating includes PTFE.

17. The handle support mechanism of claim 1 wherein the first and second friction elements comprise first and second friction discs, and the friction discs are formed of sintered powdered metal.

18. The handle support mechanism of claim 1 wherein the first and second friction elements are coated with an anti-wear coating.

19. A handle support mechanism for attachment to a mortise lock operable by first and second lever handles, the handle support mechanism comprising:

a first friction disc connected to and rotationally driven by the first lever handle when the first lever handle is turned, the first friction disc having a first friction surface and at least one notch formed therein;

a second friction disc connected to and rotationally driven by the second lever handle when the second lever handle is turned, the second friction disc having a second friction surface and at least one notch formed therein;

a free-floating U-shaped spring bracket extending to opposite sides of the mortise lock, the spring bracket having first and second spring bracket friction surfaces held in frictional contact with the friction surfaces on the first and second friction discs by inward spring pressure applied by the spring bracket, the first and second spring bracket friction surfaces having at least one dimple formed thereon, the at least one dimple on the first spring bracket friction surface cooperatively engaging the at least one notch on the first friction disc to hold the first lever handle in a level position when the second lever handle is rotated, and the at least one dimple on the second spring bracket friction surface cooperatively engaging the at least one notch on the second friction disc to hold the second lever handle in a level position when the first lever handle is rotated.

20. A handle support mechanism for attachment to a lock operable by first and second handles, the handle support mechanism comprising:

a first friction element having a friction surface, the first friction element being connected to and rotationally driven by the first handle when the first handle is turned;

a second friction element having a friction surface, the second friction element being connected to and rotationally driven by the second handle when the second handle is turned;

a first non-rotatable friction surface in frictional contact with the friction surface on the first friction element;

a second non-rotatable friction surface in frictional contact with the friction surface on the second friction element, the first and second fixed friction surfaces being non-rotatable relative to the lock; and a spring bracket holding the friction surfaces on the first and second friction elements in frictional contact with the first and second non-rotatable friction surfaces, the spring bracket providing a first inward spring force between the friction surface on the first friction element and the first non-rotatable friction surface and a second, oppositely directed, inward spring force between the friction surface on the second friction element and the second non-rotatable friction surface.

21. The handle support mechanism of claim 20 wherein:

the first friction element includes a first cylindrical bearing surface;

the second friction element includes a second cylindrical bearing surface; and the bracket includes first and second bearing holes engaging the first and second cylindrical bearing surfaces to rotationally hold the first and second friction elements.

22. The handle support mechanism of claim 20 wherein the first and second friction elements are discs.

23. The handle support mechanism of claim 20 wherein:

the bracket includes the first non-rotatable friction surface and the friction surface on the first friction element is an outer surface of the first friction element; and the bracket also includes the second non-rotatable friction surface and the friction surface on the second friction element is an outer surface of the second friction element.

24. The handle support mechanism of claim 20 wherein:

the lock is a mortise lock having a thickness; and the bracket is generally U-shaped and includes a base portion and a pair of legs separated by a distance corresponding to the thickness of the mortise lock, the legs extending to opposite sides of the mortise lock.

25. The handle support mechanism of claim 24 wherein the bracket comprises a self-aligning spring bracket not rigidly attached to the mortise lock.

26. The handle support mechanism of claim 24 wherein the base portion of the bracket is attached to a back surface of the mortise lock.

27. The handle support mechanism of claim 20 wherein the bracket is made of spring steel.

28. The handle support mechanism of claim 20 wherein the bracket and the first and second friction elements are externally mounted to the lock.

29. The handle support mechanism of claim 20 wherein the handle support mechanism is externally mounted to the lock without any fasteners.

30. The handle support mechanism of claim 20 wherein the first and second non-rotatable friction surfaces include at least one dimple in frictional contact with corresponding notches formed in the friction surfaces of the first and second friction elements.

31. The handle support mechanism of claim 30 wherein the first and second non-rotatable friction surfaces each include four dimples and the friction surfaces of the first and second friction elements each include four corresponding notches.

32. The handle support mechanism of claim 20 wherein:

the bracket comprises a spring bracket having two bearing holes;

the first friction element comprises a friction disc having a first cylindrical bearing surface and a square hole extending axially therethrough for engaging a first spindle extending from the first handle; and the second friction element also comprises a friction disc having a second cylindrical bearing surface and a square hole extending axially therethrough for engaging a second spindle extending from the second handle.

33. The handle support mechanism of claim 32 wherein the friction discs are formed of sintered powdered metal.

34. The handle support mechanism of claim 33 wherein the friction discs are coated with an anti-wear coating.

35. The handle support mechanism of claim 33 wherein the friction discs are plated with nickel before the anti-wear coating is applied.

36. The handle support mechanism of claim 34 wherein the anti-wear coating includes PTFE.

37. The handle support mechanism of claim 20 wherein the first and second friction elements comprise first and second friction discs, and the friction discs are formed of sintered powdered metal.

38. The handle support mechanism of claim 20 wherein the first and second friction elements are coated with an anti-wear coating.

* * * * *